United States Patent [19]

Kitagawa

[11] Patent Number: 4,840,099

[45] Date of Patent: Jun. 20, 1989

[54] ELECTRONIC MUSICAL INSTRUMENT

[75] Inventor: Hiroshi Kitagawa, Shizuoka, Japan

[73] Assignee: Kabushiki Kaisha Kawai Gakki Seisakusho, Japan

[21] Appl. No.: 102,408

[22] Filed: Sep. 29, 1987

[30] Foreign Application Priority Data

Oct. 4, 1986 [JP] Japan ..... 61-236862

[51] Int. Cl.[4] ..... G10H 1/00; G10H 1/02; G10H 1/06

[52] U.S. Cl. ..... 84/1.01; 84/1.22; 84/1.23; 84/1.13; 84/1.26

[58] Field of Search ..... 84/1.13, 1.01, 1.26, 84/1.03, 1.22, 1.23, 1.28, DIG. 10; 364/703, 718, 736, 751, 754, 768, 709, 745, 748

[56] References Cited

U.S. PATENT DOCUMENTS

| | | | |
|---|---|---|---|
| 4,407,018 | 9/1983 | Kanemasa | 364/736 |
| 4,511,990 | 4/1983 | Hagiwara et al. | 364/748 |
| 4,736,333 | 4/1988 | Mead et al. | 84/1.01 X |
| 4,736,663 | 4/1988 | Wawrzynek et al. | 84/1.26 |

*Primary Examiner*—Arthur T. Grimley
*Assistant Examiner*—Matthew S. Smith
*Attorney, Agent, or Firm*—McGlew & Tuttle

[57] ABSTRACT

Calculations by an envelope circuit and a waveform calculation circuit, which are principal functions of an electronic musical instrument, can be performed by the same calculation routine through use of the same general formula $A=B\pm C\times D$. Accordingly, their circuit structures are substantially simplified and the circuits can be fabricated as a one-chip large scale integrated circuit.

4 Claims, 4 Drawing Sheets

ELECTRONIC MUSICAL INSTRUMENT

BACKGROUND OF THE INVENTION

1. Field of the Invention

The present invention relates to an electronic musical instrument which is adapted to provide a musical waveform calculating function and an envelope generating function by the same calculating means.

2. Description of the Prior Art

In the prior art an envelope circuit and a waveform calculating circuit, which are considered as principal functions of an electronic musical instrument, are separated as entirely independent circuits in terms of hardware structure. Therefore, an assembly of the both circuits is so largescale that they are not suitable for fabrciation as a large scale integrated circuit, in particular, as one chip.

Based on the fact that the functions of the abovementioned waveform calculating circuit and envelope circuit could be expressed by the same general formula $A=B\pm C\times D$, the present inventor has considered to provide different functions by controlling the same calculation routine, thereby obtaining a circuit structure suitable for fabrication as a large scale integrated circuit, especially, as one chip.

SUMMARY OF THE INVENTION

An object of the present invention is to provide an electronic musical instrument of a system in which the musical waveform calculating function and the envelope generating function can be obtained following the same calculating procedure.

To attain the above object, the electronic musical instrument of the present invention comprises: multiplying means for multiplying input data C and input data D to obtain output data E; adding means for adding the output data E and input data B (or subtracting them one from the other) to obtain output data A; memory means for temporarily storing the output data A to be read out afterward; and calculation control means for controlling the multiplying and adding means to arbitrarily select, as the input data B, C and D, the output data A, waveform data, and envelope coefficient data for each step of calculation and to operate on a time-shared basis. A calculation $A=B\pm C\times D$ is performed on a time-shared basis, and the input data therefor is controlled.

With such an arrangement, calculations of different functions, such as calculations of an envelope waveform and a musical waveform, can be processed by the same calculating means. This markedly simplifies the entire circuit structure of an electronic musical instrument, permitting easy fabrication as a one-chip large scale integrated circuit.

DESCRIPTION OF THE PREFERRED EMBODIMENTS

Figure 1:
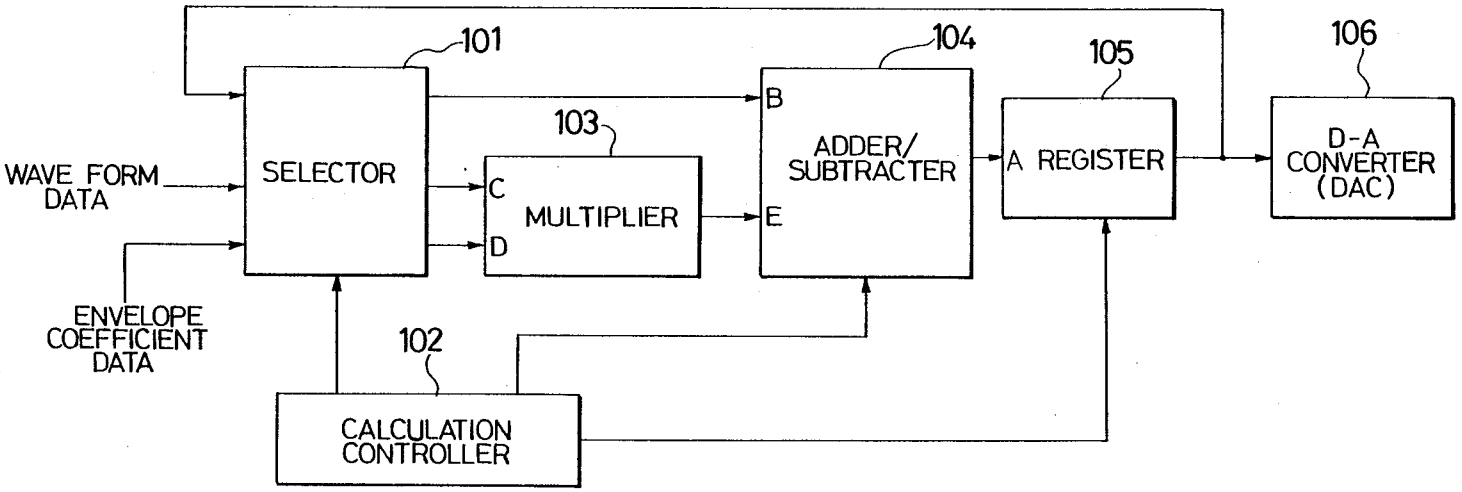
FIG. 1 is a block diagram illustrating an embodiment of the present invention.

FIG. 1 illustrates in block form the basis arrangement of the present invention. Waveform data (data read out of a waveform memory, for example), envelope coefficient data (an envelope level coefficient, envelope speed coefficient data, etc.), and output data of a register 105 which is formed by a RAM or latch are input into a selector 101. These data are properly selected according to the calculation format, under control of a calculation controller 102, for input into C and D inputs of a multiplier 103 and a B input of an adder/subtractor 104. The multiplied output E of the multipler 103 is applied to an E input of the adder/subtractor 104. The adder/subtractor 104 yields its calculated output A, which is temporarily stored in the register 105. Of the various data being stored in the register 105, data being calculated is input into the selector 101 again. The result calculated as a musical waveform is provided to a D-A converter 106, from which a musical waveform is output in analog form.

In this way, a calculation $A=B\pm C\times D$ is performed for each step of a calculation cycle.

Next, a description will be given of the application of conventional circuits of different calculation procedures to the embodiment of the present invention depicted in FIG. 1.

Figure 2:
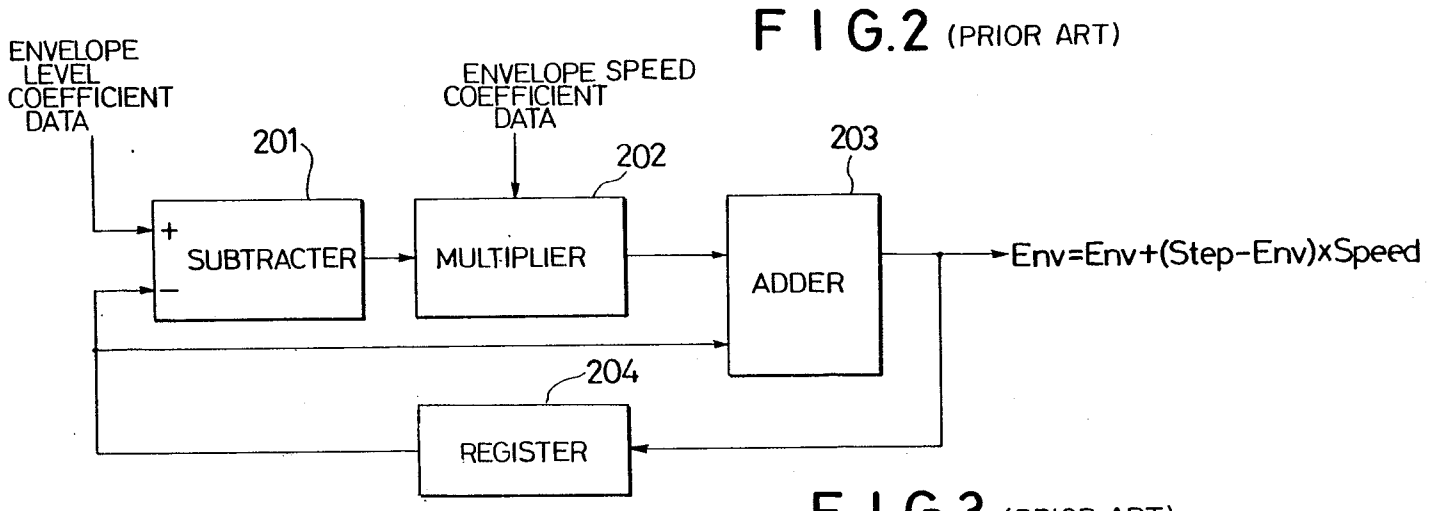
FIG.2 (PRIOR ART)
FIGS. 2, 3 and 4 are block diagrams showing examples of conventional circuits for use in an electronic musical instrument.

FIG. 2 shows in block form the conventional circuit for calculating an envelope waveform. This circuit forms a cyclic primary digital filter and operates following envelope level coefficient data (Step) at a speed dependent upon envelope speed coefficient data (Speed), implementing an analog CR characteristic.

The calculation formula for the envelope waveform is expressed by the following difference equation:

$$\text{Env}=\text{Env}+(\text{Step}-\text{Env})\times\text{Speed} \quad (1)$$

The envelope level coefficient data (Step) is input into a subtractor 201, which calculates the difference (Step−Env) between it and envelope waveform data read out of a register 204 which stores envelope data (Env) obtained at the immediately previous timing of calculation. The subtractor output is applied to one input of a multiplier 202, to the other input of which is applied the envelope speed coefficient data (Speed) and in which they are multiplied ((Step−- Env)×Speed). The multiplied output is provided to an adder 203, wherein it is added to envelope waveform data from a register 204 ((Env+Step−Env)×Speed). The added output is stored in the register 204 for readout at the next timing of calculation. The above-mentioned circuit calls for two adders and one multipler for the generation of an envelope.

Next, a description will be given of a method of calculating an envelope waveform according to the present invention.

Eq. (1) is expanded as follows:

$$X=\text{Env}-\text{Env}\times\text{Speed} \quad (2)$$

$$\text{Env}=X+\text{Step}\times\text{Speed} \quad (3)$$

(X: buffer for calculation)

As is evident from Eqs. (2) and (3), the same envelope waveform can be created by the two-step calculation through utilization of the calculation $A=B\pm C\times D$.

Figure 3:
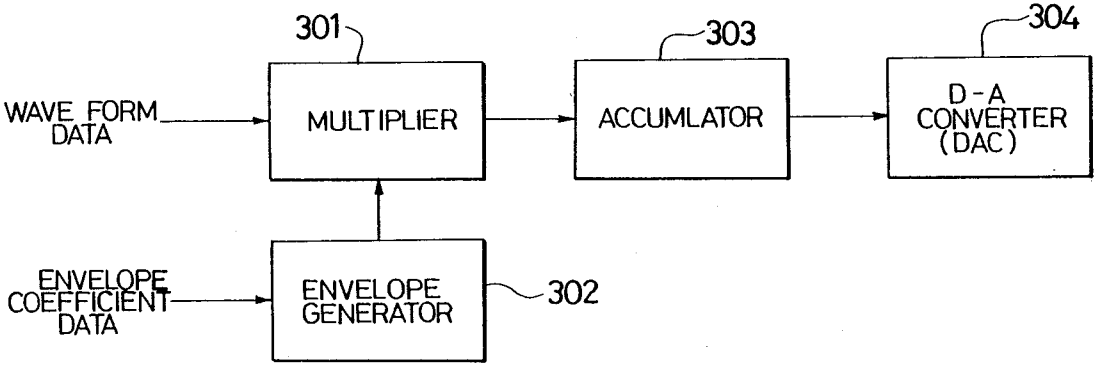
FIG.3 (PRIOR ART)

FIG. 3 shows in block form a conventional typical example of a circuit for producing a musical waveform by multiplying waveform data by an envelope waveform.

In this circuit it is a precondition to generate a plurality of tones (16 tones, for instance).

The waveform data for 16 tones are input into a multiplier 301 on a time-shared basis. On the other hand, an envelope waveform generator 302 receives envelope coefficient data and outputs envelope waveforms for the 16 tones on a time-shared basis in synchronism with the waveform data. The output of the envelope waveform generator 302 is provided to the multiplier 301.

FIG. 2 is a block diagram of a conventional example of the envelope generator for envelope waveform calculation.

The multiplied output is applied to an accumulator 303, which accumulates it for 16 tones and applied the accumulated output to a D-A converter 304. This is intended to decrease the operating speed of the D-A converter 304.

The above can be formulated as follows:

$$S=S\ 30\ \text{Wave}\times\text{Env} \quad (4)$$

(S: buffer for accumulation for 16 tones)

At the beginning of the 16 tones, the output data S takes an initial value "0".

It is apparent that according to the present invention, waveform calculations of different functions can easily be implemented using the calculation $A=B\pm C\times D$.

Figure 4:
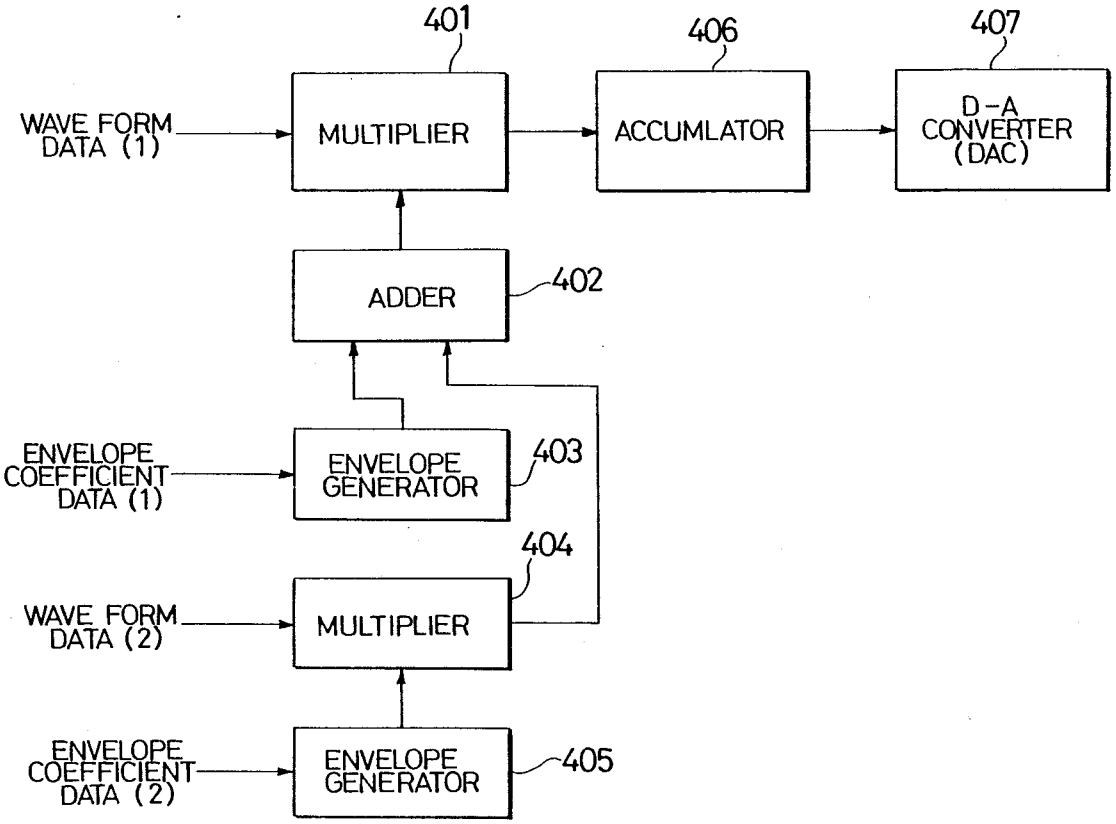
FIG. 4 (PRIOR ART)

FIG. 4 shows in block form a specific operative circuit arrangement for performing amplitude modulation between two waveforms.

The AM modulation is performed by multiplying a certain waveform by a different one. In this example, a waveform (1) is modulated by a waveform (2) as expressed as follows:

$$F=\text{Wave } 1\times(\text{Env } 1+\text{Wave } 2\times\text{Env } 2) \quad (5)$$

(F: modulated wave form),

Wave 1,2: different waveform data), (Env 1,2: different envelope data).

An envelope is used for controlling the depth of the modulation.

The waveform data (2) is applied to a multiplier 404, wherein it is multiplied by the output of an envelope waveform generator 405, thereby calculating Wave 2×x Env 2. This output is applied to an adder 402, wherein it is added to the output of an envelope waveform generator 403. The added output is provided to a multipler 401, wherein the waveform data (1) is modulated by the added output, performing the calculation Wave 1×(Env 1+Wave 2×Env 2). The above calculations are performed on a time-shared basis for generating a multiple tone. Therefore, musical data at one sample point is accumulated by an accumulator 406 and its output is provided to a D-A converter 407 for conversion into analog form.

Where the above calculation circuits shown in FIGS. 2, 3 and 4 are implemented by the present invention, it follows that:

$$Y=\text{Env } 1+\text{Wave } 2\times\text{Env } 2 \quad (6)$$

$$F=0+\text{Wave } 1\times Y \quad (7)$$

(Y: buffer for calculation)

Eq. (5) is expanded to Eqs. (6) and (7). Accordingly, the same results as obtainable with the conventional circuits of FIGS. 2, 3 and 4 can be obtained by two steps of calculations through utilization of the calculation $A=B\pm C\times D$.

By employing the circuit structure and calculation control according to the present invention, as described above, various calculations are performed on a time-shared basis with only a circuit composed only of a multiplier and an adder/subtractor; namely, different functions can be achieved by the same calculation circuit.

If the conventional circuit structures shown in Figs. 2, 3 and 4 are employed for the circuit of FIG. 1, its circuit structure is equal to that of an assembly of the conventional circuits. The circuit operates at a high speed but is difficult to fabricate as a one-chip large scale integrated circuit.

Furthermore, for instance, in the case where a sampling frequency is 50 KHz and the number of channels used is 16, a processing speed of 800 KHz (=50×16) is needed. On the other hand, it is said that a sampling frequency of 8 KHz or so is sufficient for the envelope waveform processing. Therefore, a speed of 128 KHz will do for the envelope waveform processing. This means that the envelope circuit is low in processing speed, impairing the efficiency of calculation relative to the scale of the circuit used.

According to the present invention, the calculations can be efficiently performed by thinning out their calculation steps. In other words, the circuit scale is dependent on the number of calculations, not on the kinds of calculations.

As described above, it is evident that the present invention is not limited specifically to the processing of envelope waveforms and waveform data but is applicable as well to processing by a digital filter, digital reverve, and so forth.

Figure 5:
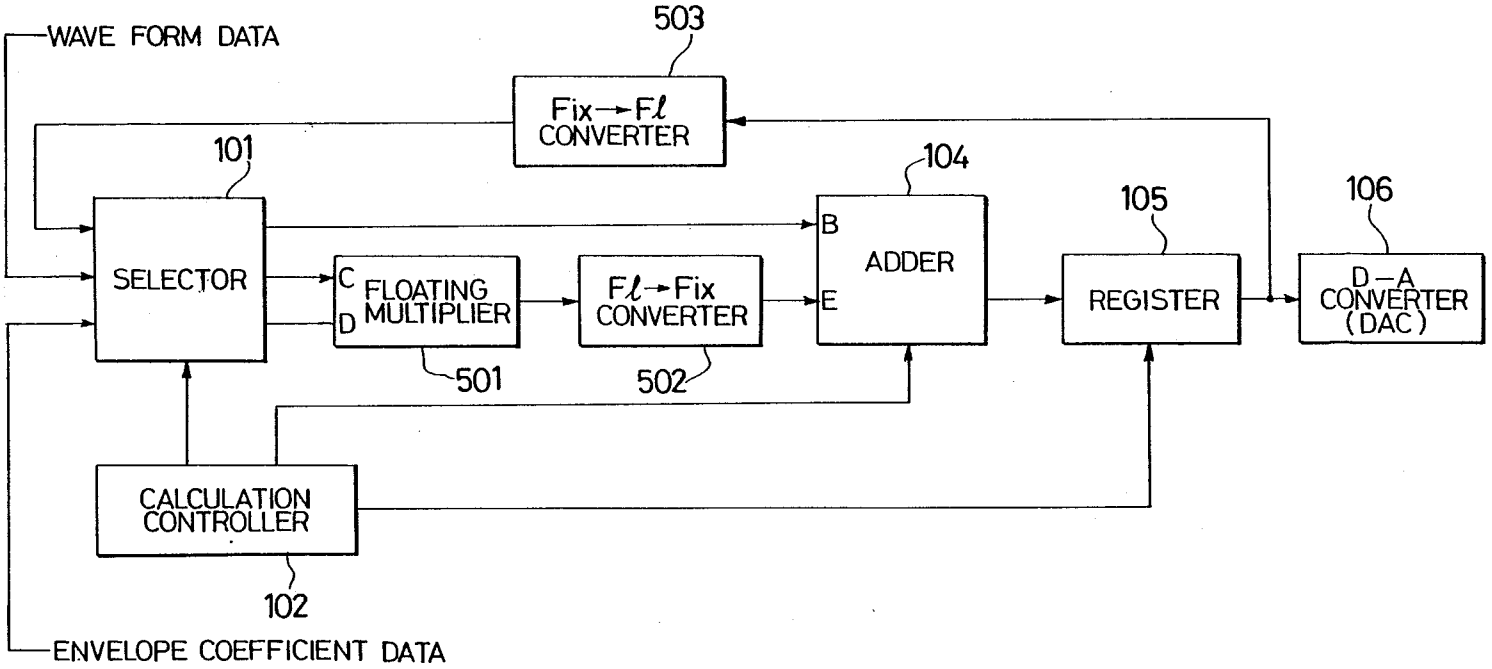
FIG. 5 is a block diagram illustrating another embodiment of the present invention.

FIG. 5 is a block diagram illustrating another embodiment of the present invention. In FIG. 1, the multiplier is used for an ordinary linear calculation (a fixed point); in this case, the circuit structure becomes bulky according to the number of bits used for the multiplication. To avoid this, the linear value X is expressed by floating points of an exponent part P and a mantissa part M (where $X=2^{-P}\times M$), and the mantissa part is formed by a multipler and the exponent by an adder. That is, a floating multipler 501 is used in place of the multiplier 103 in Fig. 1. The output data of the multiplier 501 is converted by an Fl-Fix converter 502 into a fixed point, whereas the output of the register 105 (a fixed point) is converted by a Fix-Fl converter 503 into a floating point. The operations of the other parts are the same as those in the embodiment of FIG. 1.

As described above, according to the present invention, calculations by the envelope circuit and the waveform calculation circuit, which are principal functions of an electronic musical instrument, can be performed by the same calculation routine through use of the same general formula $A=B\pm C\times D$. Accordingly, their circuit structure are markedly simplified and the circuits can be fabricated as a one-chip large scale integrated circuit.

It will be apparent that many modifications and variations may be effected without departing from the scope of the novel concepts of the present invention.

What is claimed is:

1. An electronic musical instrument comprising:

multiplying means for multipling input data C and input data D to obtain output data E;

adding means for adding the output data E and input data B, or substracting them one from the other, to obtain output data A;

memory means for temporarily storing the output data A to be read out later;

selector means which receives the output data A, waveform data and envelope coefficient data and selectively outputs the input data B, C and D;

calculation control means whereby, for a calculation $A = B + (C \times D)$, an envelope calculation represented by (1) $X = Env - Env \times Step$, (2) $Env = X + Step \times Speed$, wherein X represents a buffer for calculation, Step represents envelope level coefficient data, Speed represents envelope speed coefficient data and Env represent envelope data, and an envelope-appended musical waveform calculation represented by (3) $S = S + Wave \times Env$, wherein S represents a composite waveform in each channel and wave represents waveform data, are switched between the envelope calculation and the envelope appended musical waveform calculation them on a time-shared basis for each step of each calculation cycle; and D/A converting means whereby digital musical waveform data obtained by the calculations is converted to analog form for acoustic output;

wherein the calculation $A = B \pm C \times D$, is performed on a time-shared basis and the input data is controlled, by which calculations of different functions such as calculations of an envelope waveform and a musical waveform, are performed by the same calculation means, obtaining a musical waveform.

2. The electronic musical instrument of claim 1 which has a plurality of channels and in which the input data is controlled by the following two steps on a time-shared basis:

(1) $Y = Env\ 1 + Wave\ 2 \times Env\ 2$, (2) $A = \mathbf{O} + Wave\ 1 \times Y$, wherein Y represents a buffer for calculation, Wave 1 and Wave 2 represent different waveform data, 0 represents a zero value, and Env 1 and Env 2 represent different envelope data; whereby a musical waveform AM-modulated by a waveform of a different channel is further calculated.

3. The electronic musical instrument of claim 1, wherein the multiplying means comprises a floating point multiplier for multiplying the input data C and D which are floating points $2^{-P} \times M$ represented by an exponent part P and mantissa part M, and which further includes a fixed point converter for converting the output of the floating point multiplier for converting the output data A from the memory means into a floating point.

4. An electronic musical instrument comprising: multiplying means for multiplying input data C and input data D to obtain output data E; adding/subtracting means for adding/subtracting the output data E and input data B to obtain output data A; memory means for temporarily storing the output data A to be read out later; selector means for receiving output data A, waveform data and envelope coefficient data and for selectively outputting received data as input data B, C, and D; calculation control means for controlling said selector means, memory means and adding/subtracting means for switching between an envelope calculation and an envelope-appended musical waveform calculation on a time-shared basis for each step of each calculation cycle for an envelope calculation represented by (1) $X = Env - (Env + Step)$ (2) $Env = X + (Step \times Speed)$ wherein X represents a buffer for calculation, Step represents envelope level coefficient data, Speed represents envelope speed coefficient data and Env represents envelope data, and for an envelope - appended musical waveform calculation represented by (3) $S = S + (Wave \times Env)$ wherein S represents a composite waveform in each channel and wave represents waveform data, musical waveform data obtained by the calculations is converted to analog form for acoustic output.

* * * * *